US011794360B2

(12) United States Patent
Chang et al.

(10) Patent No.: US 11,794,360 B2
(45) Date of Patent: Oct. 24, 2023

(54) ELECTRIC KNIFE

(71) Applicant: CUTTWAY PRODUCTS CO., LTD., Taichung (TW)

(72) Inventors: Yi-Yang Chang, Taichung (TW); Tzu-Yi Lin, Taichung (TW)

(73) Assignee: CUTTWAY PRODUCTS CO.,LTD., Taichung (TW)

( * ) Notice: Subject to any disclaimer, the term of this patent is extended or adjusted under 35 U.S.C. 154(b) by 70 days.

(21) Appl. No.: 17/541,849

(22) Filed: Dec. 3, 2021

(65) Prior Publication Data

US 2023/0145219 A1 May 11, 2023

(30) Foreign Application Priority Data

Nov. 10, 2021 (TW) ..... 110213280

(51) Int. Cl.
*B26B 7/00* (2006.01)
*B26B 15/00* (2006.01)
*B25F 5/00* (2006.01)

(52) U.S. Cl.
CPC ..... *B26B 7/00* (2013.01)

(58) Field of Classification Search
CPC ... B26B 7/00; B26B 7/005; B23D 51/10; B23D 51/16; B62B 7/00; B25F 5/02
USPC .. 30/277.4, 164.9, 392, 393, 394, 165, 272.1, 30/123.7, 142, 340.5, 35; 173/170, 162.2, 114, 173/205; 206/372
See application file for complete search history.

(56) References Cited

U.S. PATENT DOCUMENTS

| | | | | |
|---|---|---|---|---|
| 3,315,356 | A * | 4/1967 | Swanke et al. | B26B 7/005 279/23.1 |
| 3,337,952 | A * | 8/1967 | Rosen | B23D 49/006 30/277.4 |
| 3,357,102 | A * | 12/1967 | Korshak | B26B 7/005 30/277.4 |
| 3,359,637 | A * | 12/1967 | Hansen | B26B 7/00 |
| 9,434,016 | B2* | 9/2016 | Zhou | B23D 49/006 |
| 9,561,552 | B2* | 2/2017 | Kocsis et al. | B25F 5/02 |
| 2003/0041464 | A1* | 3/2003 | Anders | B26B 7/00 30/142 |
| 2009/0038164 | A1* | 2/2009 | Vitantonio et al. | B26B 7/005 30/277.4 |

* cited by examiner

*Primary Examiner* — Ghassem Alie
(74) *Attorney, Agent, or Firm* — Birch, Stewart, Kolasch & Birch, LLP

(57) ABSTRACT

An electric knife includes a cutter blade, a handle, and a drive unit and a driven unit mounted inside the handle. The drive unit includes a first movable sleeve. The driven unit includes a second movable sleeve. The cutter blade is set on the second movable sleeve. The drive unit and the driven unit are connected through a link, so that the drive unit can drive the second movable sleeve of the driven unit and the cutter blade to reciprocate along an axis.

10 Claims, 7 Drawing Sheets

ELECTRIC KNIFE

BACKGROUND OF THE INVENTION

1. Field of the Invention

The present invention relates to cutting tools, especially an electric knife structure.

2. Description of the Related Art

In order to increase the effect of the cutting tool in use, there are many electric cutting tools on the market, and most of this type of cutting tools are structured by directly connecting the cutter blade to a driving device such as a motor or a vibration unit. Although this structure can provide the direct driving force of the cutter blade, it is easy to cause the output end of the driving device to be twisted and deformed or even damaged when the cutter blade is pressed. This problem should be improved.

SUMMARY OF THE INVENTION

The present invention has been accomplished under the circumstances in view. It is the main object of the present invention to provide an electric knife that is stable in structure, easy to maintain, and can protect the driving device from damage.

In order to achieve the above object, the electric knife of the present invention comprises: a cutter blade and a handle, and the handle is internally equipped with a drive unit and a driven unit. The cutter blade is located in the driven unit. The drive unit and the driven unit are connected through a link, so that the drive unit can drive the cutter blade of the driven unit to reciprocate along an axis.

According to the electric knife of the present invention with the above structure, because the drive unit and the driven unit are pivotally connected by a link, when the cutter blade on the driven unit is under pressure, the compressed pressure or twisted force can be absorbed by the link, and will not be directly transmitted to the output shaft of the motor and cause damage to the output shaft.

Preferably, the drive unit comprises a first movable sleeve, the driven unit comprises a second movable sleeve, and the first movable sleeve and the second movable sleeve are connected with the link.

Preferably, the drive unit comprises a screw with two threads in opposite directions.

Preferably, the drive unit further comprises two rolling members, which are respectively set on one side of the two threads of the screw. The two rolling members can scroll along the corresponding threads.

DETAILED DESCRIPTION OF THE INVENTION

Figure 1:
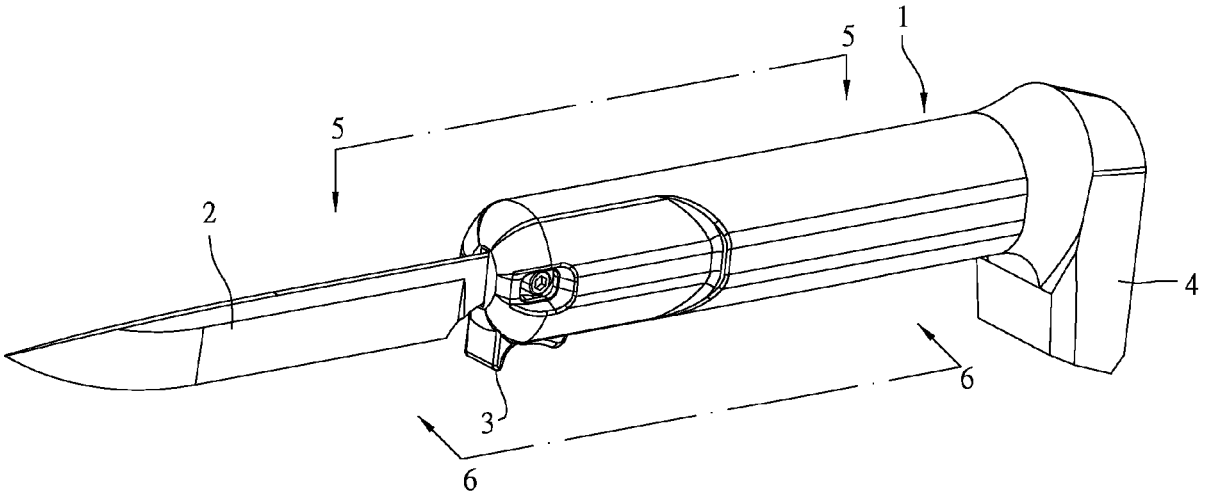
FIG. 1 is a three-dimensional schematic diagram of the appearance of the present invention.
Figure 2:
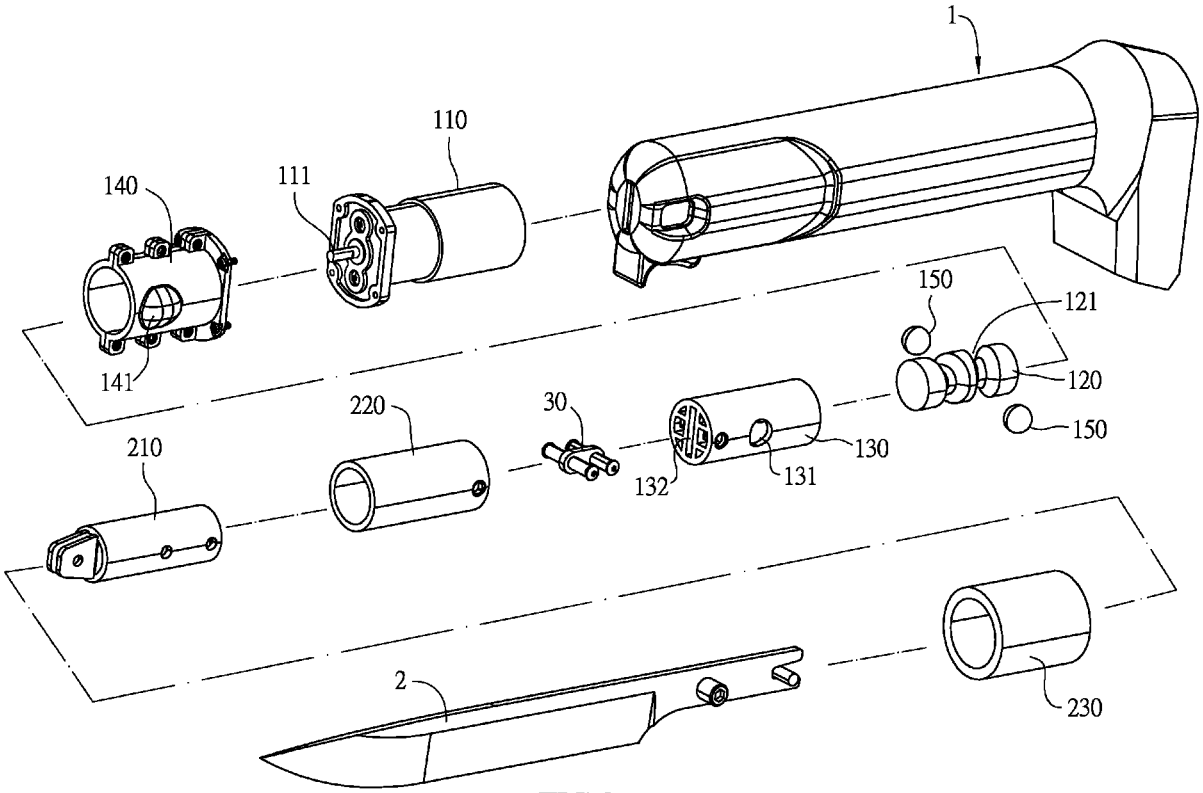
FIG. 2 is an exploded view of the present invention.
Figure 3:
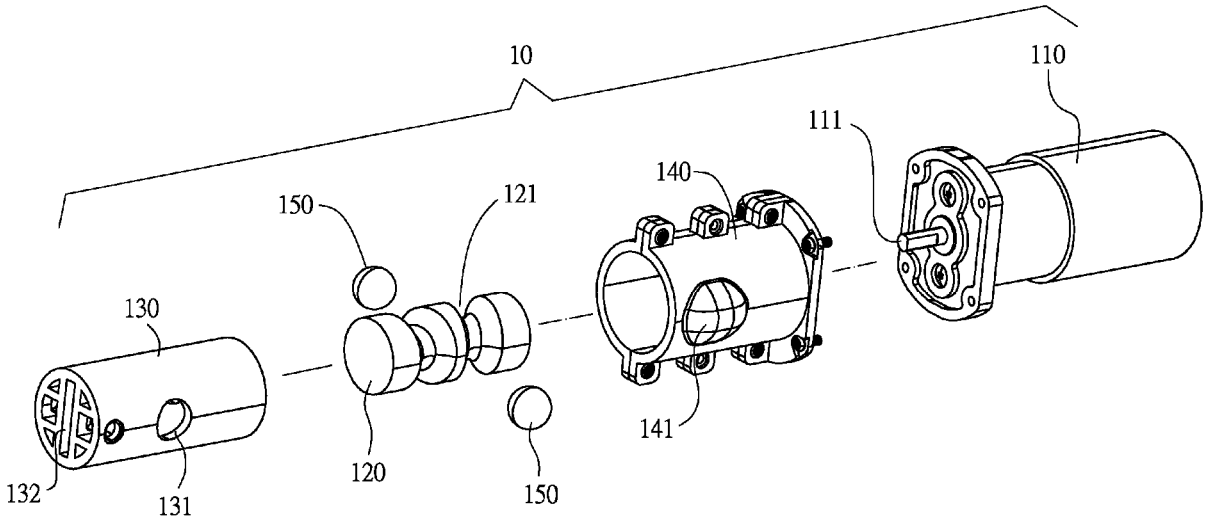
FIG. 3 is an exploded view of the drive unit of the present invention.
Figure 4:
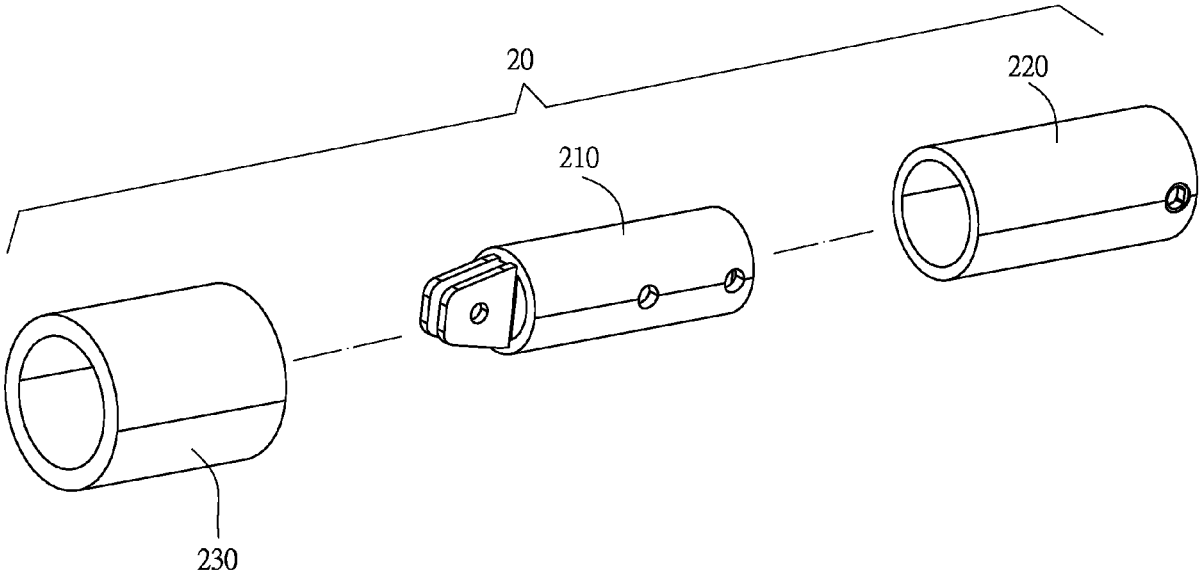
FIG. 4 is an exploded view of the driven unit of the present invention.
Figure 5:
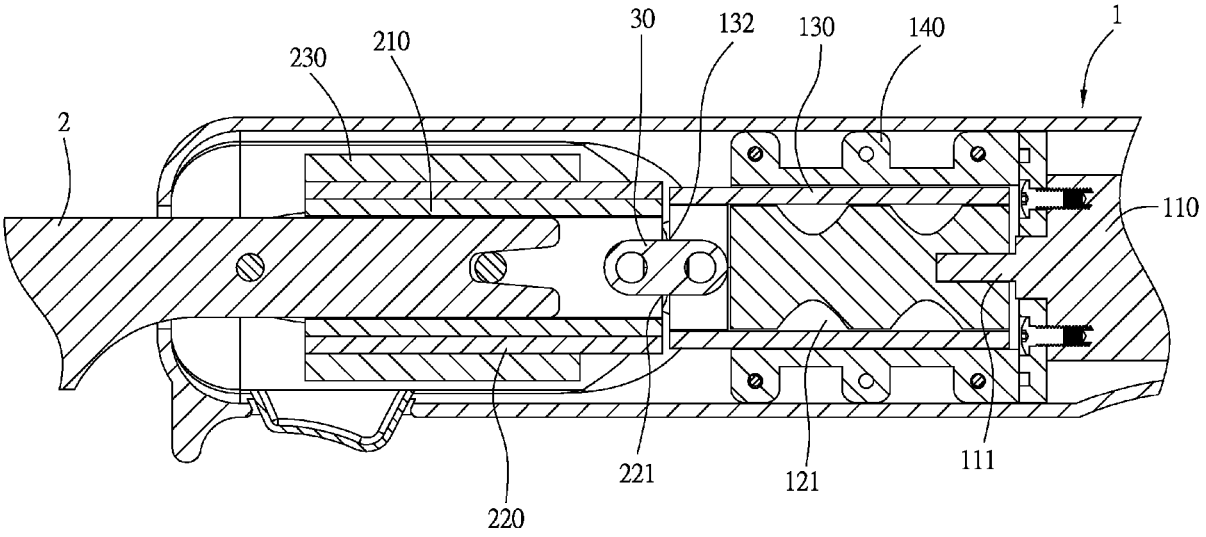
FIG. 5 is a sectional view taken along line 5-5 of FIG. 1.
Figure 6:
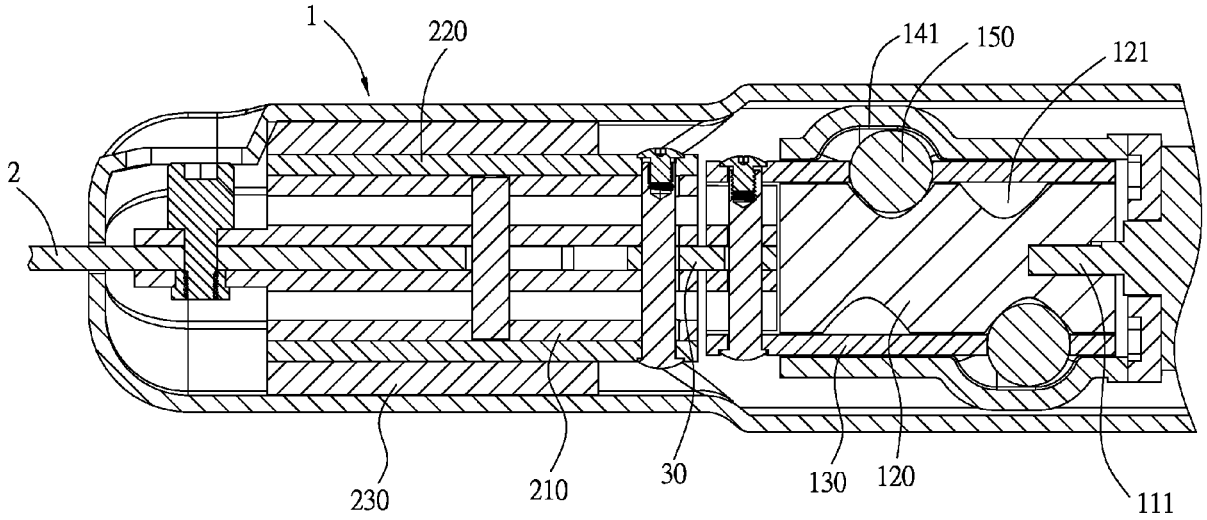
FIG. 6 is a sectional view taken along line 6-6 of FIG. 1.

The applicant first explains here that throughout the specification, including the embodiments described below and the claims in the scope of the patent application, the nouns related to directionality are based on the directions in the drawings. Secondly, in the embodiments and drawings that will be introduced below, the same element numbers represent the same or similar elements or their structural features.

Referring to FIG. 1 to FIG. 6, the electric knife of the present invention comprises: a handle 1, a cutter blade 2, a switch 3 set on the handle 1, and a power supply 4, a drive unit 10 and a driven unit 20 mounted inside the handle 1. The cutter blade 2 is located in the driven unit 20. In this embodiment, the power supply 4 is a battery, but the power supply can also be a wire directly connected to external power.

The drive unit 10 comprises a motor 110, a screw 120, a first movable sleeve 130, a first fixed sleeve 140, and two rolling members 150.

The motor 110 is located in the handle, and one end of the motor 110 has an output shaft 111.

The screw 120 is installed on the output shaft 111 of the motor and can rotate with the output shaft. The screw 120 is provided with two threads 121 in opposite directions.

The first movable sleeve 130 is set on the screw 120, and each of two opposite sides of the first movable sleeve is provided with a perforation 131.

The first fixed sleeve 140 is set outside the first movable sleeve 130. One end of the first fixed sleeve 140 is combined and fixed with the motor 110. The two sides of the first fixed sleeve 140 are provided with two long guide grooves 141 corresponding to the second perforations 131 of the first movable sleeve. The long axis of the guide grooves 141 is in the same direction as the axis of the motor output shaft 111

The two rolling members 150 are respectively set on one side of the two threads 121 of the screw, and the two rolling members 150 can roll along the corresponding threads 121. In this embodiment, the two rolling members 150 are two balls, but it is not limited to this. One side of the two rolling members 150 is attached to the threads 121 of the screw, and the other side protrudes out of the first movable sleeve 130 through the perforations 131 of the first movable sleeve. The protruding part of the two rolling members 150 will be limited in the guide grooves 141 of the first fixed sleeve.

The driven unit 20 comprises a cutter blade holder 210, a second movable sleeve 220, and a second fixed sleeve 230.

One end of the cutter blade 2 is fixed to the cutter blade holder 210.

The second movable sleeve 220 is set on the cutter blade holder 210 and is fixed in combination with the cutter blade holder 210.

The second fixed sleeve 230 is set outside the second movable sleeve 220 and fixed in the handle 1.

The drive unit 10 and the driven unit 20 are pivotally connected by a link 30, so that the second movable sleeve 220 of the driven unit can be driven by the first movable sleeve 130 of the drive unit. In this embodiment, one end of the first movable sleeve 130 of the drive unit 10 is provided with a pivot hole 132, and one end of the second movable sleeve 220 is also provided with a pivot hole 221, and the link 30 is respectively pivotally connected to the pivot hole 132 of the first movable sleeve and the pivot hole 221 of the second movable sleeve. Through this structure, the first movable sleeve 130 and the second movable sleeve 220 can be interlocked but can maintain the respective travel space of the first movable sleeve 130 and the second movable sleeve 220. In other words, the second movable sleeve 220 will not have a direct impact on the first movable sleeve 130 if it produces up, down, left, and right deflection.

With the structure of the present invention, the operation method is the same as that of general cutting tools. The user holds handle 1 and turns on the switch 3, and the output shaft 111 of the motor 110 will rotate and drive the screw 120 to rotate. The rotation of screw 120 will move the two rolling members 150 and push the first movable sleeve 130 to move. However, because the movable range of the two rolling members 150 is limited to the corresponding guide grooves 141, the first movable sleeve 130 can only move back and forth along one axis, which is the same axis as the output shaft 111 of the motor. The first movable sleeve 130 will be linked with the second movable sleeve 220 through the link 30, which will then drive the second movable sleeve 220 to move back and forth. The cutter blade holder 210 that fixes the cutter blade 2 is fixed to the second movable sleeve 220, so it will also move with the second movable sleeve 220, thereby achieving the function of reciprocating the cutter blade 2.

The advantages of the present invention are: Because the drive unit 10 and the driven unit 20 are pivotally connected by the link 30, when the cutter blade on the driven unit 20 is under pressure, the compressed pressure or twisted force can be absorbed by the link 30, and it will not be directly transmitted to the output shaft 111 of the motor and cause damage to the output shaft.

In addition, because the drive unit and the driven unit are separated in the present invention, each unit does not need to be disassembled and replaced during maintenance, and the maintenance is easier.

Figure 7:
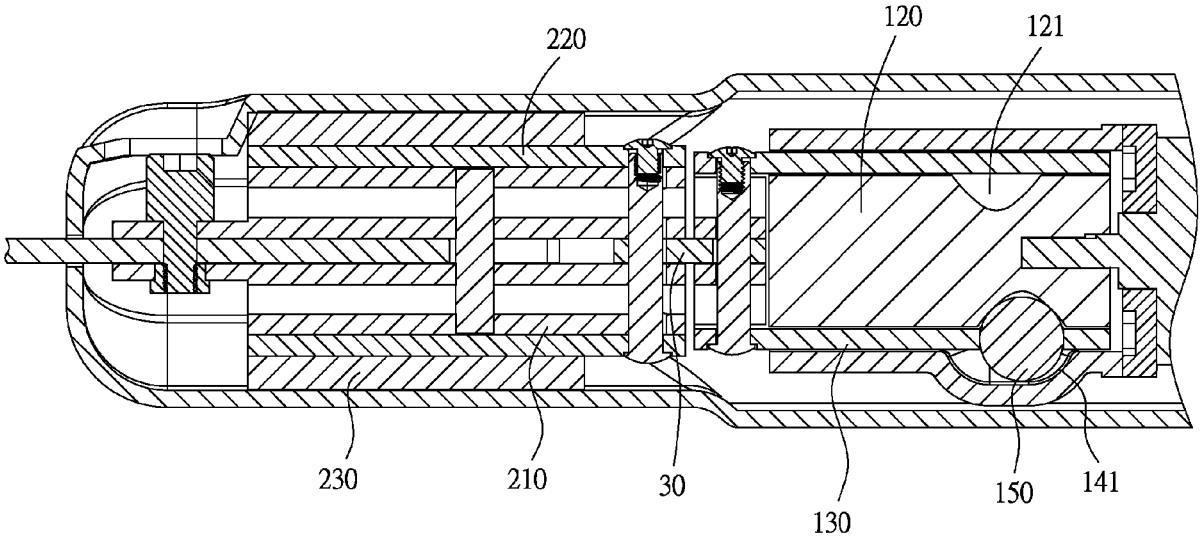
FIG. 7 is the same as FIG. 6, which is a schematic cross-sectional view of another embodiment of the screw and the first fixed sleeve in the creation.

In addition, it should be noted that in the above embodiment, two rolling members 150 and two threads 121 are provided on the screw 120, but one rolling member 150 and one thread 121 can also be used, as shown in FIG. 7. Using two rolling members and two threads can have a better balance, but using one rolling member and one thread can also make the first movable sleeve move back and forth.

In addition, in this embodiment, the cutter blade holder 210 and the second movable sleeve 220 are separated into two components because of the convenience of assembly. The cutter blade holder 210 and the second movable sleeve 220 can also be combined into a single component, that is, the cutter blade 2 can be directly fixed to the second movable sleeve 220. The second fixed sleeve 230 can also be combined with the handle 1 to become a part of the handle 1. Similarly, the first fixed sleeve can also be combined with the handle to become one.

What is claimed is:

1. An electric knife, comprising a cutter blade, a handle, and a drive unit and a driven unit mounted inside said handle, wherein:

said drive unit comprises a motor with an output shaft, a screw set in said output shaft of said motor and rotatable with said output shaft, said screw comprising a thread, a first movable sleeve set on said screw, said first movable sleeve having one side thereof provided with a perforation, a first fixed sleeve fixed inside said handle and sleeved outside said first movable sleeve, said first fixed sleeve having one side thereof provided with a long guide groove corresponding to said perforation of said first movable sleeve, a rolling member located on one side of said thread of said screw and rollable along said thread, said rolling member having one side thereof attached to said thread of said screw and an opposite side thereof protruding out of said first movable sleeve through said perforation of said first movable sleeve, and the protruding part of said rolling member being limited in said long guide groove of said first fixed sleeve;

said driven unit comprises a cutter blade holder holding one end of said cutter blade and a second movable sleeve sleeved on said cutter blade holder and fixed with said cutter blade holder, said second movable sleeve and said first movable sleeve being pivotally connected with a link, so that said second movable sleeve is drivable by said first movable sleeve.

2. The electric knife as claimed in claim 1, wherein said driven unit further comprises a second fixed sleeve set outside said second movable sleeve and fixed in said handle.

3. The electric knife as claimed in claim 2, wherein said cutter blade holder and said second movable sleeve are combined into a single component.

4. The electric knife as claimed in claim 3, wherein said first movable sleeve has one end thereof provided with a pivot hole, said second movable sleeve has one end thereof provided with a pivot hole, and said link is pivotally connected to the pivot hole of said first movable sleeve and the pivot hole of said second movable sleeve.

5. The electric knife as claimed in claim 4, wherein said handle is externally equipped with a switch and internally equipped with a power supply.

6. An electric knife, comprising a cutter blade, a handle, and a drive unit and a driven unit mounted inside said handle, wherein:

said drive unit comprises a motor with an output shaft, a screw set in said output shaft of said motor and rotatable with said output shaft, said screw comprising two threads in opposite directions, a first movable sleeve set on said screw, said first movable sleeve having two opposite sides thereof respectively provided with a perforation, a first fixed sleeve fixed inside said handle and sleeved outside said first movable sleeve, said first fixed sleeve having two opposite sides thereof respectively provided with a long guide groove corresponding to the two perforations of said first movable sleeve, two rolling members respectively located on one side of said two threads of said screw and rollable along the respective said threads, each said rolling member having one side thereof attached to the associating said thread of said screw and an opposite side thereof protruding out of said first movable sleeve through one respective said perforation of said first movable sleeve, and the protruding part of each said rolling member being limited in the respective said long guide groove of said first fixed sleeve;

said driven unit comprises a cutter blade holder holding one end of said cutter blade and a second movable sleeve sleeved on said cutter blade holder and fixed with said cutter blade holder, said second movable sleeve and said first movable sleeve being pivotally connected with a link, so that said second movable sleeve is drivable by said first movable sleeve.

7. The electric knife as claimed in claim 6, wherein said driven unit further comprises a second fixed sleeve set outside said second movable sleeve and fixed in said handle.

8. The electric knife as claimed in claim 7, wherein said cutter blade holder and said second movable sleeve are combined into a single component.

9. The electric knife as claimed in claim 8, wherein said first movable sleeve has one end thereof provided with a pivot hole, said second movable sleeve has one end thereof provided with a pivot hole, and said link is pivotally connected to the pivot hole of said first movable sleeve and the pivot hole of said second movable sleeve.

10. The electric knife as claimed in claim 9, wherein said handle is externally equipped with a switch and internally equipped with a power supply.

* * * * *